United States Patent [19]

Wells

[11] Patent Number: 4,494,523

[45] Date of Patent: Jan. 22, 1985

[54] WIRE SAW

[75] Inventor: Raymond C. Wells, Scottsdale, Ariz.

[73] Assignee: Motorola, Inc., Schaumburg, Ill.

[21] Appl. No.: 520,776

[22] Filed: Aug. 5, 1983

[51] Int. Cl.[3] ..... B28D 1/08

[52] U.S. Cl. ..... 125/16 R; 125/21; 83/651.1; 83/785

[58] Field of Search ..... 125/12, 16 R, 21; 83/651.1, 785

[56] References Cited

U.S. PATENT DOCUMENTS 3,824,982 7/1974 Bowman ..... 125/16 R 3,942,508 3/1976 Shimizu ..... 125/16 R

*Primary Examiner*—Harold D. Whitehead

*Attorney, Agent, or Firm*—Paul F. Wille

[57] ABSTRACT

An improved wire saw is disclosed in which a linear wire storage means comprises a vertically moving carriage. The carriage is supported by the wire, thereby improving the efficiency and production rate of the saw.

5 Claims, 4 Drawing Figures

WIRE SAW

BACKGROUND OF THE INVENTION

The invention relates to apparatus for sawing materials into a plurality of thin slices and, in particular, to sawing brittle materials such as quartz, ceramic, or silicon.

In the prior art, a variety of saws are known, including wire saws, for cutting brittle material. One particularly useful saw is described in U.S. Pat. No. 3,824,982, which is assigned to the assignee of the present invention and the disclosure of which is hereby incorporated by reference.

As described in said patent, the wire saw comprises a wire supply means and a wire take-up means. The actual cutting mechanism comprises wire looped around a plurality of pulleys or mandrels, each having at least one groove therein, arrayed to form a cutting zone. The saw also comprises a wire storage means having a sliding carriage, with at least one pair of pulleys thereon, mounted between a corresponding pair of fixed pulleys. Wire from the supply means follows a path through the storage means and the plurality of pulleys in the cutting mechanism to the take-up means. A reversible motor drives one of the plurality of pulleys in the cutting mechanism, causing the carriage in the wire storage means to move back and forth horizontally along the rail or track to which it is mounted. As the carriage reaches the end of its travel, the motor is reversed, thereby reversing the direction of the carriage.

The system may also include suitable sensing and adjusting means, eg. for wire tension, direction, and feed rate. In the particular application of cutting wafers from a silicon ingot, the system also includes means for applying and removing a suitable slurry coating for the wire.

As useful and productive as the wire saw described in the above noted patent is, it is desired to improve its capacity at least in terms of the cutting rate. In the semiconductor industry, this is particularly important since the diameter of the silicon ingots from which wafers are cut has increased. The increase in diameter, assuming the same width kerf, changes the volume of material which must be removed in proportion to the square of the change in diameter. Thus, a twenty-five percent increase in diameter causes a fifty-six percent increase in volume. If the cutting rate were unchanged, the number of wafers per hour from the wire saw would be reduced in proportion to the increase in volume. One is thus confronted with the choice of buying additional equipment or improving existing equipment.

In view of the foregoing, it is therefore an object of the present invention to improve the cutting rate of a wire saw.

Another object of the present invention is to improve the operation of the wire storage means of a wire saw.

A further object of the present invention is to provide a wire saw of simplified construction.

SUMMARY OF THE INVENTION

The foregoing objects are achieved in the present invention wherein the carriage in the wire storage means is suspended and supported by the cutting wire and positioned to move freely in a vertical direction.

BRIEF DESCRIPTION OF THE DRAWINGS

A more complete understanding of the present invention can be obtained by considering the following detailed description in conjunction with the accompanying drawings, in which.

Detailed Description

Figure 1:
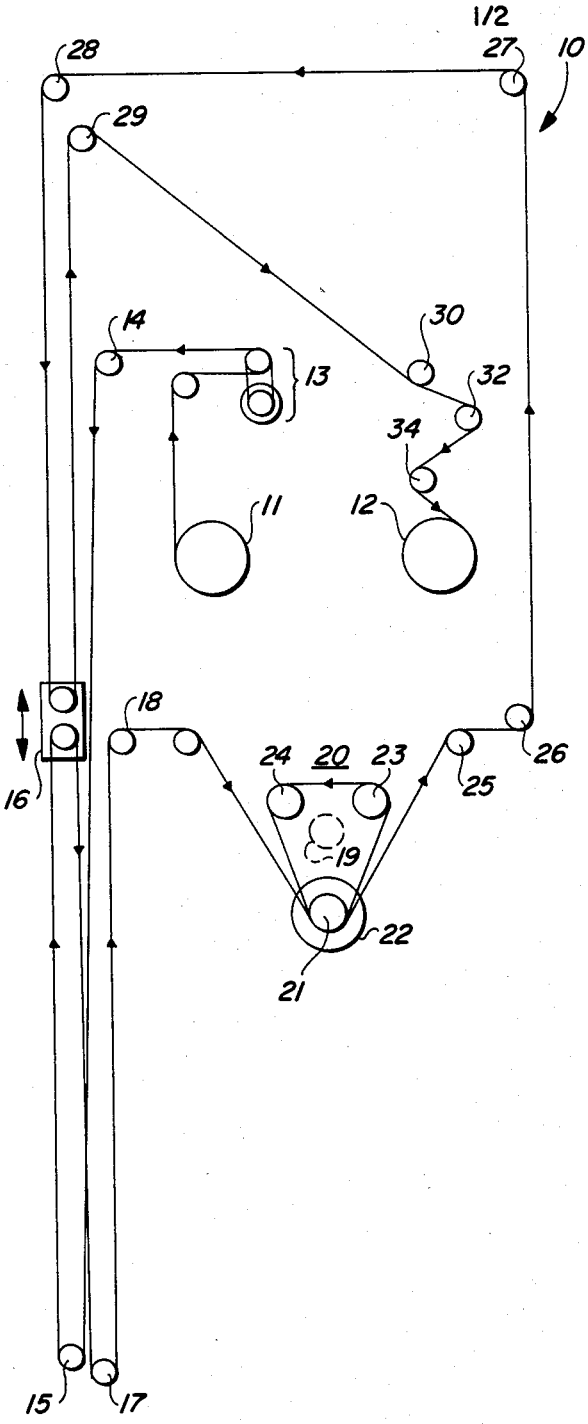
FIG. 1 illustrates a preferred embodiment of the present invention.

FIG. 1 illustrates schematically the continuous path taken by the wire in wire saw 10 as it proceeds from supply reel 11 through the system to take-up reel 12. As illustrated in FIG. 1, the wire from supply reel 11 passes over a fixed pulley to a moveable pulley which is part of a tension adjusting mechanism 13. From there, the wire passes over fixed pulley 14 to fixed pulley 15 which forms part of the wire storage means. The cutting wire then passes over a first pulley attached to moveable carriage 16 and then to fixed pulley 17. From there, the wire passes over various fixed pulleys, pulley 18 for example, which serve to position the wire on its way to the cutting zone.

The cutting zone is defined by three pulleys, 21, 23 and 24, which are arrayed in a triangular configuration to define a cutting zone within. One of these pulleys such as pulley 21, is driven by a suitable, reversible motor 22. These three pulleys and the drive motor, comprise the actual cutting mechanism 20 of the wire saw. As known to those of skill in the art, the number of slices made by the saw is determined by the number of loops taken by the wire about the cutting zone.

The wire exits cutting mechanism 20 and passes over fixed pulleys 25, 26, 27 and 28 which serve to re-orient the wire on its way to the wire storage mechanism. Fixed pulleys 28 and 29 are the fixed upper end of the wire storage mechanism. The wire passes over pulley 28 around the upper pulley of carriage 16 and then over pulley 29. From there, the wire passes across pulleys 30, 32 and 34 to take-up reel 12. Thus, the wire storage mechanism comprises fixed end pulleys 15, 17, 28, and 29 and the pulleys on carriage 16.

While not illustrated as such, pulley 32 may be part of an additional wire tensioning means, if desired. Pulley 30, for example, can be attached to a suitable tachometer for monitoring the feed rate of the wire from supply reel 11 to take-up reel 12. As understood by those of skill in the art, by virtue of moveable carriage 16, the wire travels at two speeds within the system. The low speed portion of the system comprises supply reel 11, tension adjusting means 13, pulleys 14 and 15, on the supply side, and pulleys 29, 30, 32 and 34 on the take-up side of the system. The remaining pulleys carry the wire at much higher speed and in two directions under the control of reversing motor 22. As illustrated in FIG. 1, if motor 22 rotates pulley 21 in a counterclockwise direction, carriage 16 is pulled downwardly to supply wire to cutting mechanism 20. Carriage 16 proceeds downward until a predetermined limit is reached, at which point suitable sensing circuitry, known per se in the art, provides a control signal for reversing the direction of motor 22. When motor 22 rotates clockwise, carriage 16 is driven in an upward direction to a predetermined upper limit. At this point the rotation of motor 22 is again reversed and the carriage proceeds downwardly, continuing the cycle.

A silicon ingot, or other material to be sliced, as represented by broken line 19 within the cutting zone, is directed slowly against the wire, thereby initiating the cutting action.

Figure 2:
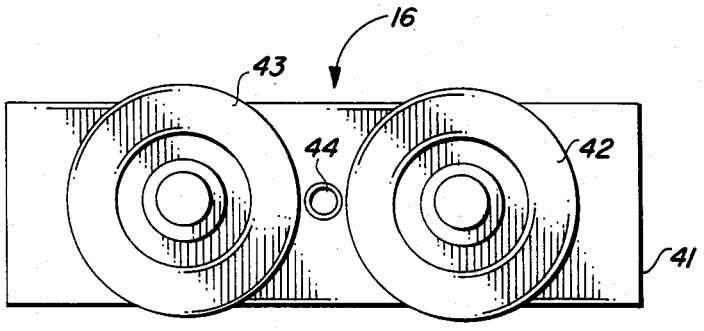
FIG. 2 illustrates a front view of a carriage means in accordance with the present invention.
Figure 3:
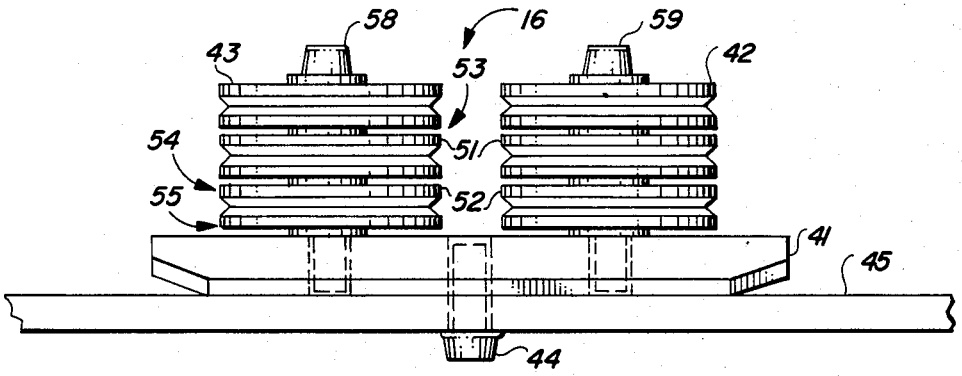
FIG. 3 illustrates a side view of a carriage in accordance with the present invention.

FIGS. 2 and 3 illustrate a preferred embodiment of moveable carriage 16 in accordance with the present invention in which a carriage block 41 has pulleys 42 and 43 mounted thereon so that the axes of pulleys 42 and 43 are in spaced apart, parallel relationship. Carriage block 41 has centrally located pin 44 which fits within a hole in shield 45. The hole in shield 45 is approximately centrally located along the travel of carriage block 41. Pin 44 secures carriage block 41 during webbing, ie. while the cutting wire is strung across the pulleys, and is then removed. Carriage block 41 is then freely suspended within shield 45 during operation of the wire saw.

More than one pulley can be provided in the wire storage mechanism at each location illustrated in FIG. 1, thereby increasing its capacity. Specifically, with respect to carriage 16, additional pulleys 51 and 52 are added and spaced from each other and from pulleys 42 and 43 by suitable washers, such as 53, 54, and 55. Pins 58 and 59 attach their respective stacks of pulleys and washers to carriage block 41. In a preferred embodiment of the the present invention, the bearings for the respective pulleys are slightly larger than the thickness of the pulley thereby assuring that the pulley does not contact the washer.

Figure 4:
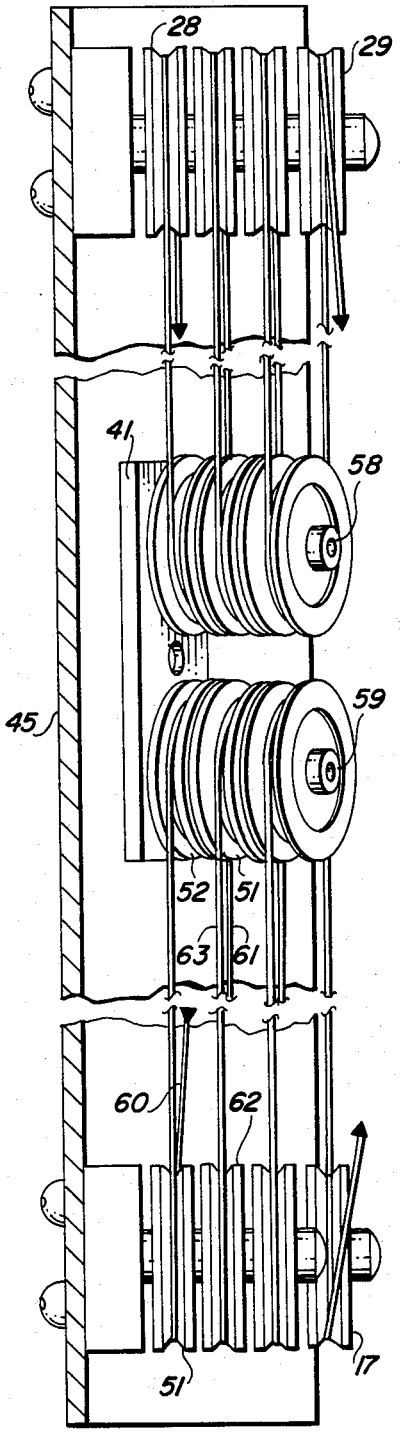
FIG. 4 illustrates the suspension of the carriage block in accordance with the present invention.

FIG. 4 illustrates a portion of a fully webbed saw. The path followed by the wire is the same as that illustrated in FIG. 1 except that the wire storage means contains several loops of wire to increase its capacity. The loops of wire form a helix whose pitch is determined by the separation of the grooves of adjacent pulleys. For example, as illustrated in FIG. 4, wire 60 travels from the feed reel, around pulley 15 to pulley 52. After passing over pulley 52, the wire, indicated by reference number 61, extends to pulley 62. In so doing, the wire is displaced laterally the distance between the grooves of pulleys 15 and 62. This displacement causes a problem in that it is undesirable for the wire to rub the sides of the grooves of the pulleys. An advantage of the present invention is that freely suspended carriage 16 solves the problem by twisting slightly so that the axes of the pulleys on the carriage, while parallel to each other, are not parallel to the axes of the fixed pulleys at either end of the wire storage means. The result is that the grooves at the front of the carriage pulleys, as seen in FIG. 4, are aligned with the respective grooves at the front of the fixed end pulleys and the grooves at the rear of the carriage pulleys are aligned with the grooves at the rear of the adjacent fixed end pulleys. Thus, the construction of the carriage is simplified and the wire storage means is self-adjusting in operation. While the slight twist is not obtained during webbing, since the carriage is attached to shield 45, there is no wear problem since there is very little wire movement.

There is thus provided by the present invention an improved wire saw of simplified construction and increased cutting rate due to the fact that the carriage is supported only by the cutting wire and moves vertically. In a device built in accordance with the present invention, the rate for cutting a silicon ingot was increased by one hundred percent. This increase corresponds to an increase in diameter of the wafers of forty-one percent. Thus the present invention not only accommodates the current change in diameter of the silicon ingot but also increases the number of wafers produced per hour by the wafer saw.

Having thus described the invention it will be apparent to those of skill in the art that various modifications can be made within the spirit and scope of the present invention. For example, one may wish to provide additional tension adjusting means, particularly if the number of pulleys on the wire storage means is increased since this substantially increases the length of wire extending from the supply reel to the take-up reel. While the pulleys are illustrated as cantilever mounted on carriage block 41, the carriage block may be extended to encircle the pairs of pulleys within so that the shaft upon which the pulleys rotate is supported at both ends. While illustrated as a triangular zone into which the work piece is inserted, it is appreciated by those of skill in the art that the work zone may have other shapes or use sides other than the top for cutting. Likewise it is understood that the work piece can be fed from within the zone through the wire to outside the polygon shape, or fed from outside the polygon shape through one side to the area within. Also, depending upon system requirements and the length of the wire, more than one drive motor can be utilized to control the motion of the wire across the pulleys.

I claim:

1. In a wire saw apparatus having a wire supply means, a wire takeup means, a plurality of wire guides defining a continuous path between said supply means and said take-up means and defining a cutting zone, and a reversible motor driving a pulley in said continuous path, the improvement comprising:

wire storage means in said continuous path comprising carriage means having at least one pair of pulleys having separate axes, wherein said carriage means moves vertically between predetermined limits and is supported only by the wire in said wire storage means.

2. The apparatus as set forth in claim 1 wherein said carriage means comprises a plurality of pairs of pulleys.

3. The apparatus as set forth in claim 2 wherein the axis of one pulley from each pair is collinear with the axis of one pulley from each of the remainder of said pairs.

4. The apparatus as set forth in claim 1 wherein said axes are parallel.

5. The apparatus as set forth in claim 4 wherein said wire storage means comprises at least one pair of fixed end pulleys whose axes are not parallel to the axes of said carriage pulleys.

* * * * *